United States Patent [19]

Argo et al.

[11] Patent Number: 4,764,978

[45] Date of Patent: Aug. 16, 1988

[54] EMERGENCY VEHICLE RADIO TRANSMISSION SYSTEM

[76] Inventors: Eckert H. Argo, 7680 Elk Cir., Prescott Valley, Ariz. 85319; Ralph A. Baglino, 4834 W. Banff La., Glendale, Ariz. 85306

[21] Appl. No.: 87,674

[22] Filed: Aug. 20, 1987

[51] Int. Cl.[4] ..... H04K 3/00

[52] U.S. Cl. ..... 455/1; 455/99; 340/902

[58] Field of Search ..... 455/1, 89, 101, 102, 455/124, 125; 340/902, 905; 455/93, 99

[56] References Cited

U.S. PATENT DOCUMENTS

| | | | |
|---|---|---|---|
| 2,994,765 | 8/1961 | Adam | 455/1 |
| 3,660,811 | 5/1972 | Vail et al. | 455/1 |
| 3,760,349 | 9/1973 | Keister et al. | 340/902 |
| 3,949,300 | 4/1976 | Sadler | 455/1 |
| 4,238,778 | 12/1980 | Ohsumi | 455/99 |
| 4,394,777 | 7/1983 | Wren | 455/99 |
| 4,443,790 | 4/1984 | Bishop | 340/902 |
| 4,587,522 | 5/1986 | Warren | 340/902 |
| 4,706,086 | 11/1987 | Panizza | 340/902 |

*Primary Examiner*—Robert L. Griffin
*Assistant Examiner*—Curtis Kuntz
*Attorney, Agent, or Firm*—H. Gordon Shields

[57] ABSTRACT

Radio transmission apparatus usable for emergency vehicles transmits a radio frequency signal on both standard AM frequencies and FM broadcast frequencies to alert vehicles in the path of the emergency vehicle that the emergency vehicle is approaching. The frequencies are broadcast over the entire frequency spectrum so that vehicles using their radios will receive the signal, regardless of what particular frequency is being tuned by their receivers. A crystal controlled oscillator using frequency dividers generates carrier frequencies that are precisely on each AM and FM frequency.

15 Claims, 2 Drawing Sheets

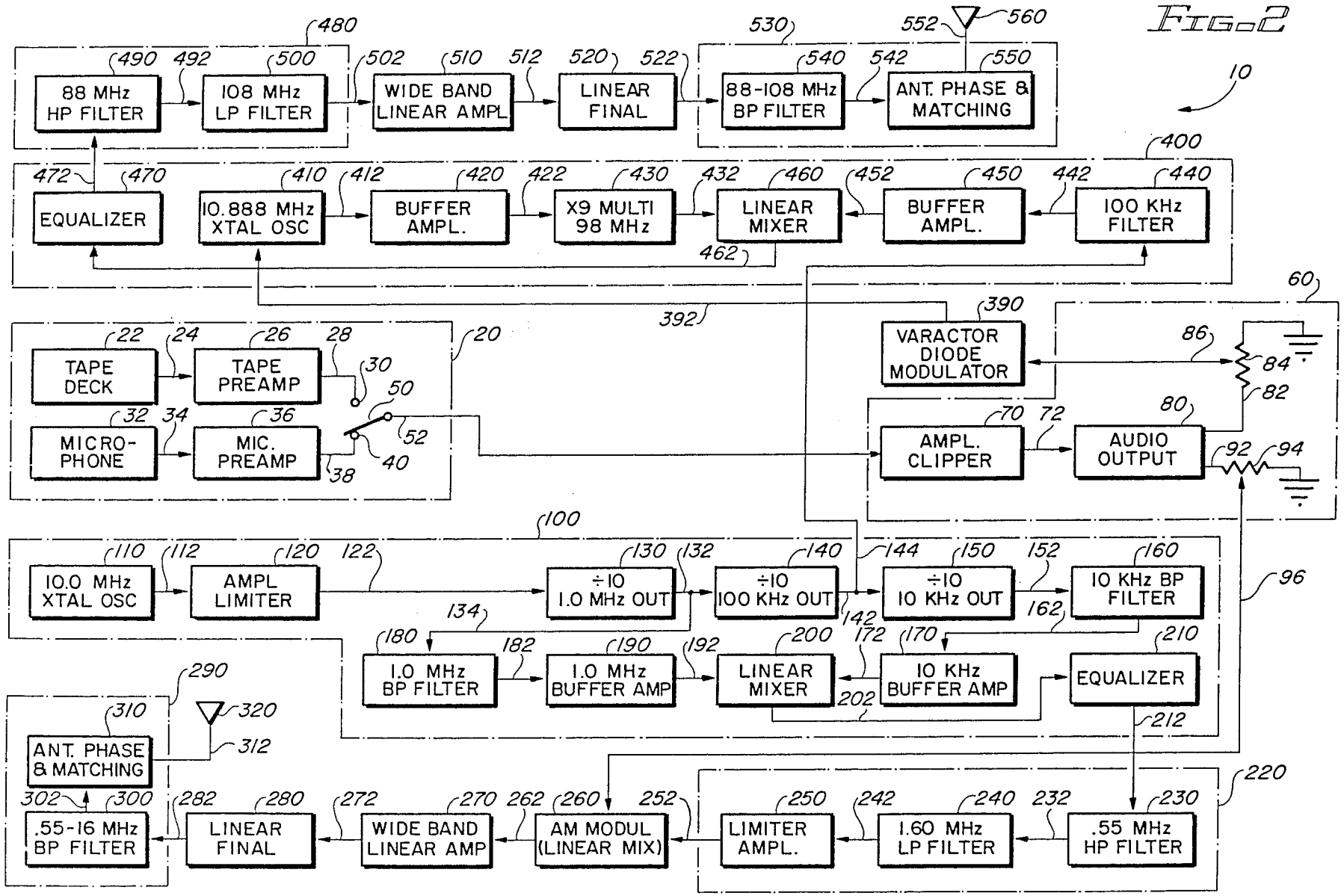
Fig-2
10
88 MHz HP FILTER
108 MHz LP FILTER
WIDE BAND LINEAR AMPL
LINEAR FINAL
88-108 MHz BP FILTER
ANT. PHASE & MATCHING
EQUALIZER
10.888 MHz XTAL OSC
BUFFER AMPL.
X9 MULTI 98 MHz
LINEAR MIXER
BUFFER AMPL.
100 KHz FILTER
TAPE DECK
MICRO-PHONE
TAPE PREAMP
MIC. PREAMP
VARACTOR DIODE MODULATOR
AMPL. CLIPPER
AUDIO OUTPUT
10.0 MHz XTAL OSC
AMPL LIMITER
÷10 1.0 MHz OUT
1.0 MHz BP FILTER
1.0 MHz BUFFER AMP
÷10 100 KHz OUT
LINEAR MIXER
÷10 10 KHz OUT
10 KHz BUFFER AMP
10 KHz BP FILTER
EQUALIZER
ANT. PHASE & MATCHING
.55-16 MHz BP FILTER
LINEAR FINAL
WIDE BAND LINEAR AMP
AM MODUL (LINEAR MIX)
LIMITER AMPL.
1.60 MHz LP FILTER
.55 MHz HP FILTER

EMERGENCY VEHICLE RADIO TRANSMISSION SYSTEM

BACKGROUND OF THE INVENTION

1. Field of the Invention

This invention relates to radio transmitters and, more particularly, to radio transmitters for emergency vehicles for transmitting a relatively low powered radio signal on a plurality of AM and FM frequencies along the path of emergency vehicles.

2. Description of the Prior Art

The generation of radio signals for overriding standard AM and FM broadcast frequencies by emergency vehicles is not new. However, the prior art systems utilize an oscillator sweeping back and forth across the particular frequency band and modulation is impressed upon the swept output of the oscillator. As a receiver receives the swept signal, the detected output is simply the sweep rate of the transmitter. Accordingly, any modulation impressed upon the carrier frequencies is generally below the level of the carrier. The result is that the emergency message being broadcast is generally relatively unintelligible.

Several patents illustrate the prior art concepts in emergency vehicle transmissions. For example, U.S. Pat. No. 2,994,765 (Adam) discloses an electronic system that sweeps a particular band to cause interference on all of the frequencies of the receiver. The interference either simulates a siren or else broadcasts a message.

U.S. Pat. No. 3,660,811 (Vail et al) discloses a radio system in which the frequency of a transmitter is swept acorss the receiver band to provide a warning sound. The tuning system of thr transmitter is mechanically activated to move tuning slugs. Both AM And FM receivers are affected by the directional jamming signals from the system.

U.S. Pat. No. 3,673,560 (Barsh et al) discloses a system that broadcasts to an adapter connected to a standard receiver. The receiver apparatus requires that an adapter be pre-connected to the receiver. The regular radio reception is overrridden by the adapter, so that the broadcast message from an emergency vehicle is received. It will be noted that this system requires an adapter, and accordingly vehicles whose radios do not have the adapter will not receive the message from the emergency vehicle.

U.S. Pat. No. 3,710,313 (Kimball et al) discloses a system which also requires an additional device or adapter connected to a radio receiver in a vehicle. The apparatus is specifically adapted to FM radios. Again, a special adapter is required, and vehicles without the adapter will not receive the broadcast message.

U.S. Pat. No. 3,949,300 (Sadler) discloses a transmitter which sweeps across a frequency band. Sweepingis accomplished at an audio rate. Both AM and FM frequencies are affected.

U.S. Pat. No. 4,443,790 (Bishop) discloses a system in which AM and FM transmitters in an emergncy vehicle are driven by oscillators which cover the entire AM and FM frequency bands. The sweeping of the bands is accomplished at a predetermined rate.

SUMMARY OF THE INVENTION

The invention described and claimed herein comprises a broadcast system for emergency vehicles which broadcasts over AM and FM broadcast frequencies utilizing a crystal controlled oscillator with frequency dividers to generate carrier frequencies on each AM and FM broadcast frequency.

Among the objects of the present invention are the following:

to provide new and useful radio transmitter apparatus;

to provide new and useful emergency vehicle radio transmission apparatus covering AM band and FM band frequencies;

to provide new and useful radio broadcast apparatus utilizing a crystal controlled oscillator and frequency dividers to provide a radio output on a plurality of radio frequencies;

to provide new and useful radio apparatus for broadcating a warning message from an emergency vehicle;

to provide new and useful radio apparatus broadcasting substantially simultaneously on AM and FM radio frequencies;

to provide new and useful radio broaadcast apparatus utilizing comb frequency generators to generate AM band and FM band carrier frequencies;

to provide new and useful radio broadcast apparatus covering substantially all assigned AM and FM broadcast frequencies; and to provide new and useful emergency radio apparatus utilizing crystal controlled oscillator and frequency dividers to provide for the broadcasting of a message on a plurality of AM and FM broadcast frequencies.

BRIEF DESCRIPTION OF THE DRAWING

FIG. 2 is a detailed block diagram schematically illustrating the apparatus of the present invention.

DESCRIPTION OF THE PREFERRED EMBODIMENT

Figure 1:
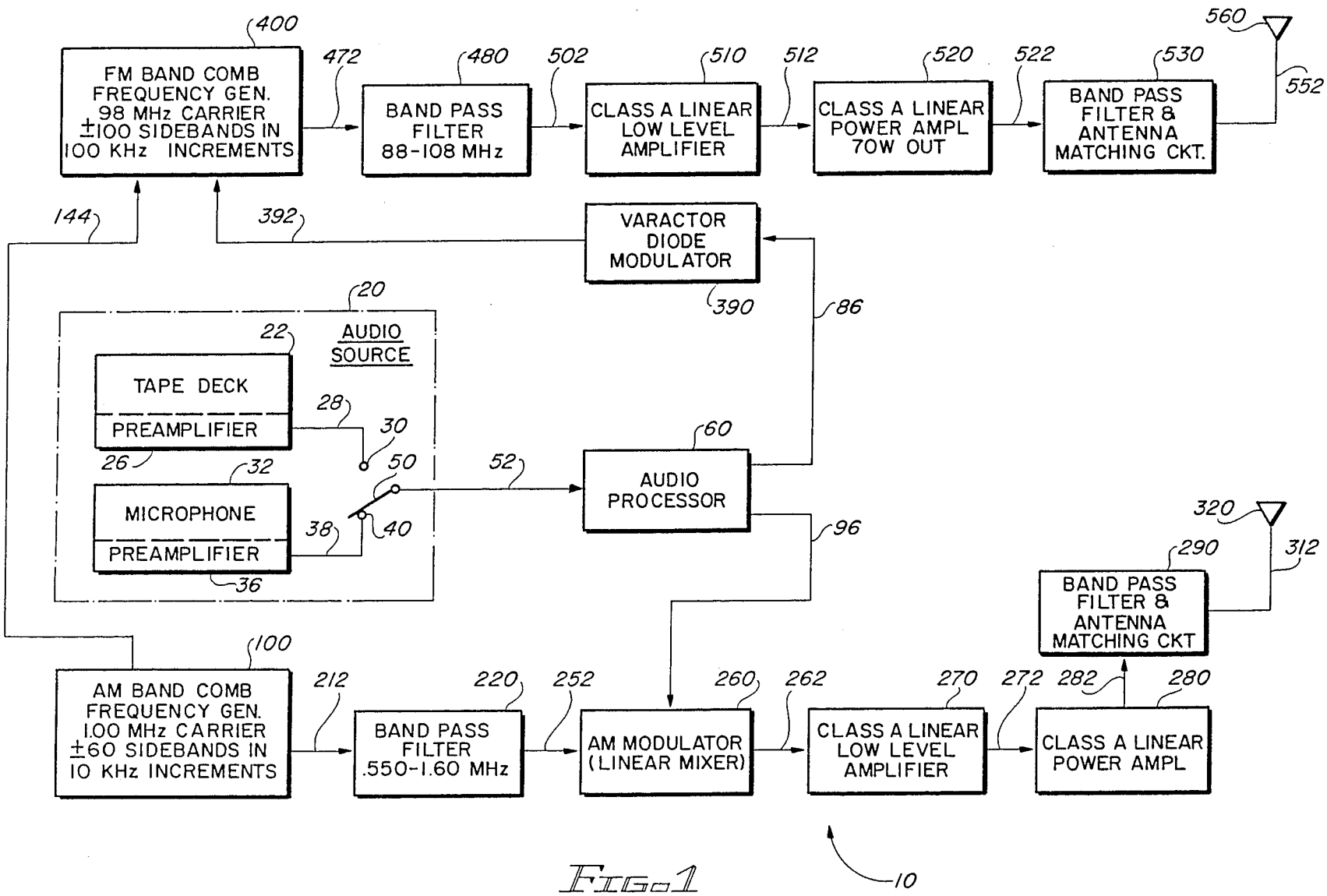
FIG. 1 is a block diagram illustrating the apparatus of the present invention.

Emergency vehicle radio transmission apparatus 10 of the present invention is illustrated in the block diagram found in both FIGS. 1 and 2. In FIG. 2, some of the blocks illustrated in FIG. 1 are shown in greater detail illustrating the various components included in the various blocks. Thus, FIG. 2 is a block diagram in substantially greater detail than FIG. 1, and it shows in detail the elements included in the apparatus of the present invention.

At the outset, it will be noted that there are two major portions of the apparatus of the present invention, both of which are illustrated in FIGS. 1 and 2. The two major components include an amplitude modulation band transmitter (AM) and a frequency modulation (FM) band transmitter. An emergency vehicle thus substantially simultaneously broadcasts on the AM band and the FM band to alert radio receivers in vehicles regardless of whether the vehicles have AM radios or FM radios in operation.

Referring specifically to FIG. 1, the transmitter apparatus 10 includes an audio source block 20 connected to an audio processor block 50. The audio source block 20 includes both a tape deck source 22 and a microphone source 32. A tape preamplifier 26 is connected to the tape deck 22 and a microphone preamplifier 36 is connected to the microphone 32.

From the tape preamplifier 26, a conductor 28 is shown extending to a terminal 30. From the microphone preamplifier 36 a conductor 38 extends to a terminal 40.

A switch 50 may be selectively switched between terminals 30 and 40 to determine the particular input or source for the audio processor 60. A conductor 52 extends from the switch 50 to the audio processor block 60.

The tape deck 22 will probably be used more than the microphone 32. Accordingly, switch 50 will probably be connected to terminal 30 more than to terminal 40. The tape deck 22 may preferably include a pre-recorded tape which may have thereon siren or the like sound and audio information warning traffic of the emergency vehicle. However, if the operator of the emergency vehicle so desires, the switch 50 may be connected to the terminal 40 to allow the broadcast of real time information from the emergency vehicle through the microphone 32.

The audio processor block 60 includes a conductor 86 which extends to a varactor diode modulator 390. A conductor 96 also extends from the audio processor block 60. The conductor 96 extends to an AM modulator or linear mixer block 260. The varactor diode modulator 390 modulates the FM signal, while the AM modulator or linear mixer 260 modulates the AM signal.

An AM band combination comb frequency generator 100 generates a one megahertz (MHz) carrier frequency with plus and minus 60 side bands in ten kilohertz (KHz) increments. The AM band comb frequency generator 100 will be discussed in more detail in conjunction with FIG. 2.

A conductor 212 extends from the comb generator 100 to a band pass filter block 220. The band pass filter block 220 allows the frequencies in the AM band, from 550 KHz to 1600 KHz, to pass.

A conductor 252 extends from the band pass filter 220 to the AM modulator 260. The AM modulator 260, a linear mixer, takes the frequencies generated by the comb generator 100, as passed through the filter 220, and modulates the audio information from the audio processor 60.

The AM signal, as modulated in the mixer 260, is connected to a linear low level amplifier 270. A conductor 262 extends from the modulator 260 to the amplifier 270.

The linear low level amplifier 270 is connected to a linear power amplifier 280 by a conductor 272. The amplified signal from the amplifier 280 is transmitted to a band pass filter and antenna matching network 290 by a conductor 282. From the band pass filter and antenna matching network 290, the AM broadcast signal is sent to an AM broadcast antenna 320 by a conductor 312. The AM signal from the audio processor 260 is transmitted from the antenna 320 on all of the frequencies in the AM band.

For the FM band broadcasting, the modulated signal from the audio processor 80 through the conductor 86 and the modulator 390 is transmitted to an FM band comb frequency generator 400 on a conductor 392. The conductor 392 extends from the modulator 390 to a comb frequency generator 400 for the FM band frequencies. A second frequency signal is transmitted from the AM frequency band 100 to the FM frequency generator 400 on a conductor 144. As will be discussed in conjunction with FIG. 2, both frequency generators 100 and 400 include crystal oscillators to provide the desired frequencies.

From the FM frequency generator 400, a conductor extends to the band pass filter 480. Band pass filter 480 allows only the FM frequencies of 88 MHz to 108 MHz to pass.

The FM frequencies, modulated with the audio information, then are amplified by two amplifiers, a linear low level amplifier 510 and a linear power amplifier 520. The band pass filter 480 is connected to the amplifier 510 by a conductor 502, and the two amplifiers are connected by a conductor 512.

The amplifier FM signal extends from the amplifier 520 to a band pass filter and antenna matching circuit block 530 by a conductor 522. From the band pass filter and antenna matching circuit block 530, a conductor 552 extends to an FM broadcast antenna 560.

The antennas 320 and 560 transmit the audio information from the audio source 20 on all of the AM broadcast frequenices in the AM band, 550–1600 KHz, and on all of the FM broadcast frequencies from 88–108 MHz. The information is transmitted substantially simultaneously. Due to the power constraints on both the AM and the FM transmissions, the design of the transmitting antennas, the broadcast radius is relatively well defined so that only traffic in the immediate vicinity, and forward of the using emergency vehicle is affected. The antennas, not part of the present invention, transmit the AM and FM signals in a relatively well defined area in a limited vertical and limited horizontal pattern.

FIG. 2 is a relatively detailed diagram, still in block form, of the radio transmission apparatus 10. The audio source block 20 is shown as including the tape deck 22 and the tape preamplifier 26 connected by a conductor 24. The microphone 32 is shown connected to the microphone preamplifier by a conductor 34.

The selector switch 50 extends to an amplifier clipper 70 in the audio processor block 60. The amplifier clipper 70 is connected to an audio output block 80 by a conductor 72.

The audio output block 80 is connected to both the AM and the FM portions of the apparatus 10. A conductor 82 extends from the audio output block 80 to a potentiometer 84. A conductor 86 extends from the potentiometer 84 to the varactor diode modulator 390 of the FM portion of the apparatus 10.

A conductor 92 extends from the audio output block 80 to a potentiometer 94. A conductor 96 extends from the potentiometer 94 to the AM modulator or linear mixer 260 of the AM portion of the apparatus 10.

The AM band comb generator block 100 includes a ten MHz crystal oscillator 110. The ten MHz output from the oscillator 110 is transmitted to an amplifier limiter 120 by a conductor 112. The amplifier limiter 120 is connected to a decade divider or divide by ten circuit 130 by a conductor 122.

The output from the decade divider 130 is a one MHz signal The one MHz singal is transmitted to a second decade divider or divide by ten circuit 140 by a conductor 132. A conductor 134 extends from the conductor 132 to a one MHz band pass filter 180.

The output from the second divide byten or decade divider circuit 140 extends to a third decade divider or divide by ten circuit 150 by a conductor 142. A conductor 144 extends from the conductor 142 to the FM band comb generator apparatus 400.

The output from the decade divider 140 is a 100 KHz output signal. The 100 KHz signal then is transmitted to both the divide by ten circuit 150 and the FM comb generator 400.

The output from the divide by ten circuit 150 is ten KHz signal. The ten KHZ signal is transmitted on a conductor 152 to a ten KHz band pass filter 160. A ten KHz buffer amplifier 170 is disposed between a linear mixer 200 and the band pass filter 160. The band pass filter 160 is connected to the buffer amplifier 170 by a conductor 162. The amplifier 170 is connected to the mixer 200 by a conductor 172.

The one MHz output signal from the divide by ten circuit 130 on conductors 132 and 134 extends to a one MHz band pass filter 180. The one MHz band pass filter 180 is connected to the linear mixer 200 through a buffer amplifier 190. A conductor 182 extends from the filter 180 to the amplifier 190, and a conductor 192 extends from the amplifier 190 to the mixer 200.

The linear mixer 200 receives both the one MHz signal from the amplifier 190 and the ten KHz signal from the amplifier 170. The ten KHz signal from the amplifier 170 comprises the side bands in the AM frequency band from the 1.0 MHz signal from the amplifier 190.

From the mixer 200, a conductor 202 extends to an equalizer circuit 210. The output from the equalizer circuit 210 on a conductor 212 extends to a high pass filter 230. The equalizer circuit 210 comprises a parallel tuned circuit which equalizes the output of the apparatus at all of the AM frequencies. The frequencies generated in the comb frequency generator 100 by the crystal oscillator 110 and the decade dividers have variable outputs on both sides of the One MHZ (one thousand KHz) frequency. The equalizer circuit 210 generally equalizes the output at all of the frequencies.

The high pass filter 230 allows frequencies above 550 KHz (0.55 MHz) to pass. The output from the high pass filter 230 extends to a low pass filter 240 on a conductor 232.

The low pass filter 240 allows only frequencies below 1600 KHz (1.6 MHz) to pass. The output from the filter 240 to a limiter amplifier 250 on conductor 242 includes the desired AM frequencies from 550 KHz to 1600 KHz in ten KHz increments. Thus, all of the AM broadcast frequencies are included in the signal on conductor 242 to the amplifier 250. The filters 230 and 240 and the amplifier 250 comprises the band pass filter block 220.

The output from the band pass filter block 220 is transmitted on the conductor 252 from the amplifier 250 to the AM modulator 260, which comprises a linear mixer. Input to the linear mixer 260 includes the frequency output from the filter block 220 and the audio output on the conductor 96 from the audio processor block 60. The audio input and the frequency input are mixed in the lInear mixer 260. The mixed signal is transmitted from the mixer 260 to a three-stage wide band linear amplifier 270 on a conductor 262. The output from the mixer or AM modulator 200 is, of course, the amplitude modulated signal in which each of the AM frequencies is appropriately modulated by the audio output signal.

Output from the three-stage linear amplifier 270 is transmitted to the power amplifier or linear final amplifier 280 on the conductor 272. The amplified signal is transmitted from the amplifier 280 by the conductor 282 to the band pass filter and antenna matching network block 290.

Within the band pass filter and antenna matching network 290 is a 550 KHz to 1600 KHz (0.55 to 1.6 KHz) band pass filter. Only the output signal in the AM band of 550 to 1600 KHz passes through the filter 300. The filtered output is transmitted on a conductor 302 to an antenna phase and matching network block 310. The conductor 312 extends from the block 310 to the antenna 320.

The FM band comb frequency generator 400 includes a 10.888 crystal oscillator 210. The FM modulated audio signal from the varactor diode modulator 390 extends to the crystal oscillator 410 on the conductor 392. From the oscillator 410, a conductor 412 extends to a buffer amplifier 420. The amplifier 420 is connected to a Times 9 multiplier circuit 430 by a conductor 432. The buffer amplifier 420 is thus between the crystal oscillator 410 and the Times 9 frequency multiplier circuitry 430. The output of the multiplier circuitry 430 is a 98 MHz signal. The 98 MHz signal is transmitted to a linear mixer 460 by a conductor 432.

The 100 KHz output from the divide by ten circuit 140 is transmitted to a 100 KHz filter 440 by the conductors 142 and 144. The 100 KHz filtered output from the filter 440 extends to a buffer amplifier 450 on a conductor 442. Output from the buffer amplifier 450 is transmitted to the liner mixer 460 by a conductor 452.

The linear mixer 4460 receives two inputs,t he frequency modulated 98 MHz output fromthemultiplier circuit 430 and the 100 KHz, or a 0.1 MHz signalf romt he amplifier 450. The 100 KHz or 0.1 MHz input comprises the 0.1 MHz side bands from the FM frequency band when mixed with the 98 MHz signal.

The output from the linear mixer 460 extends to an equalizer circuitry block 470 on a conductor 462. The equalizer circuitry 470 performs substantially the same function for the FM frequency outputs as the equalizer circuitry 210 performs for the Am frequency outputs. From the equalizer circuit 470, the conductor 472 extends to the band pass filter block 480.

The band pass filter block 480 includes two filters, a high pass filter 490 and a low pass filter 500. The two filters are connected by a conductor 492.

The high pass filter 490 passes only frequencies above 88 MHz. The low pass filter 500 passes only frequencies below 108 MHz. Thus, the output from the band pass filter 480 on conductor 502 to the amplifier 510 includes a frequency modulated signal on each of the FM band frequencies from 88 to 108 MHz.

The 510 is a wide band linear low level amplifier. Output from the amplifier 510 extends on the conductor 512 to the linear power amplifier 520. Both amplifiers 510 and 520 are class A amplifiers, as are the AM band amplifiers 270 and 280.

The amplifier output from the amplifier 520 on the conductor 522 extends to the band pass filter and antenna matching circuit block 530. The band pass filter and antenna matching circuitry 530 includes a band pass filter 540 and an antenna phase and matching circuitry block 550. The band pass filter 540 allows only signals in the frequency range of 88 to 108 MHz to pass. The band pass filter 540 is connected to the output antenna phase and matching network circuitry 550 by a conductor 542. The conductor 552 extends fromt he antenna phase and matching network circuitry 550 to the antenna 560 for transmitting the FM signal.

Again, all of the FM broadcast frequencies are included in the output from the antenna 560, just as all of the AM frequencies are transmitted by the AM transmitter antenna 320. Thus, the same audio is broadcast substantially simultaneously on all of the AM broadcast frequencies and on all of the FM broadcast frequencies.

The apparatus is selectively switchable between a tape input and a live or real time input by the switch 50.

While the principles of the invention have been made clear in illustrative embodiments, there will be immediately obvious to those skilled in the art many modifications of structure, arrangmenents, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What we claim is:

1. Emergency vehicle radio transmission system, comprising, in combination:

audio source means for providing an audio output to be broadcast;

audio processor means for processing the output of the audio source means for broadcasting on AM frequencies and on FM frequencies;

AM band comb frequency generator means for generating AM band frequencies;

AM modulator means for modulating the amplitude of the processed audio output on the AM band frequencies;

first amplifier means for amplifying the modulated audio output on the AM band frequencies;

first antenna means for transmitting the amplified audio output on the AM band frequencies;

FM band comb frequency generator means for generating FM band frequencies;

FM modulator means for modulating the processed audio output on the generated FM band frequencies to provide a modulated FM output signal;

second amplifier means for amplifying the FM output signal on the FM frequency band; and second antenna means for transmitting the amplifier FM output signal on the FM frequency band substantially simultaneously with the transmission on the AM band frequencies.

2. The apparatus of claim 1 in which the AM band comb frequency generator means includes first oscillator means for providing a first frequency;

divider means for dividing the first frequency, including first divider means to provide a second frequency in the Am band of frequencies, and second divider means to provide a third frequency in the AM band of frequencies; and mixer means for mixing the second and third frequencies to provide an output signal including substantilly all of the frequencies in the AM frequency band.

3. The apparatus of claim 2 in which the AM band comb frequency generator means further includes AM equalizer means for equalizing the output of the mixer means at all of the frequencies in the AM frequency band.

4. The apparatus of claim 3 which further includes first filter means for filtering the output of the equalizer means.

5. The apparatus of claim 4 which further includes second filter means for filtering the output of the first amplifier means.

6. The apparatus of claim 1 in which the FM band bomb frequency generator means includes oscillator means connected to the FM modulator means for providing a first FM frequency modulated by the FM modulator means.

7. The apparatus of claim 6 in which the AM band comb frequency generator means includes third divider means for providing a third frequency in the AM band of frequencies, and the third frequency is transmitted to the FM band comb frequency generator.

8. The apparatus of claim 7 in which the FM band comb frequency generator means further includes mixer means for mixing the first FM frequency modulated by the FM modulator means and the third frequency in the AM band of frequencies for providing an output signal including substantially all of the frequencies in the FM frequency band.

9. The apparatus of claim 8 in which the FM band comb frequency generator means further includes FM equalizer means for equalizing the output of the mixer means at all of the frequencies in the FM frequency band.

10. The apparatus of claim 9 which further includes third filter means for filtering the output of the second equalizer means.

11. The apparatus of claim 10 which further includes filter means for filtering the output of the second amplifier means.

12. The apparatus of claim 1 in which the AM band comb frequency generator means includes first crystal oscillator means for generating a first frequency;

first decade divider means for dividing the first frequency to provide a second frequency, and the second frequency comprises a primary frequency in the AM frequency band;

second decade divider means for dividing the second frequency to provide a third frequency, and the third frequency comprises an input signal to the FM band comb frequency generator means to provide the frequency interval of the FM frequency band side bands;

third decade divider means for dividing the third frequency to provide a fourth frequency, and the fourth frequency comprises the frequency interval of the AM frequency band side bands for mixing with the second frequency to provide the AM band frequencies.

13. The apparatus of claim 12 in which the FM band comb frequency generator means includes second crystal oscillator means for generating a fifth frequency, and the fifth frequency is modulated by the FM modulator means to provide a modulated frequency output.

14. The apparatus of claim 13 in which the FM band comb frequency generator means further includes multiplier means for multiplying the modulated frequency output to provide a primary frequency in the FM frequency band.

15. The apparatus of claim 14 in which the FM band comb frequency generator means further includes mixer means for mixing the primary frequency in the FM band and the third frequency from the second decade divider to provide the modulated FM output signal on the FM frequencies of the FM band.

* * * * *